US009322555B2

(12) United States Patent
LeBegue et al.

(10) Patent No.: US 9,322,555 B2
(45) Date of Patent: Apr. 26, 2016

(54) CAP ASSEMBLY FOR A BUNDLED TUBE FUEL INJECTOR

(71) Applicant: General Electric Company, Schenectady, NY (US)

(72) Inventors: Jeffrey Scott LeBegue, Simpsonville, SC (US); Patrick Benedict Melton, Horse Shoe, NC (US); James Harold Westmoreland, III, Greer, SC (US); James Scott Flanagan, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 446 days.

(21) Appl. No.: 13/932,317

(22) Filed: Jul. 1, 2013

(65) Prior Publication Data

US 2015/0000284 A1 Jan. 1, 2015

(51) Int. Cl.

| | |
|---|---|
| ***F23R 3/10*** | (2006.01) |
| ***F23R 3/28*** | (2006.01) |
| *F23D 14/62* | (2006.01) |

(52) U.S. Cl.

CPC . *F23R 3/10* (2013.01); *F23R 3/283* (2013.01); *F23R 3/286* (2013.01); *F23D 14/62* (2013.01); *F23R 2900/00005* (2013.01); *F23R 2900/00012* (2013.01)

(58) Field of Classification Search

CPC ..... F23R 3/10; F23R 3/283; F23R 3/286; F23R 2900/00005; F23R 2900/00012; F23R 3/60; F23R 3/28; F02M 53/08; F23D 14/62; F23D 14/64; F23D 2211/00

USPC ..... 60/740; 239/132.3, 584

See application file for complete search history.

(56) References Cited

U.S. PATENT DOCUMENTS

| | | | | |
|---|---|---|---|---|
| 4,408,461 | A | 10/1983 | Bruhwiler | |
| 4,454,711 | A * | 6/1984 | Ben-Porat | F23R 3/10 60/748 |
| 5,274,991 | A * | 1/1994 | Fitts | F23R 3/283 60/39.37 |
| 6,298,667 | B1 * | 10/2001 | Glynn | F23R 3/002 29/889.2 |
| 6,928,823 | B2 | 8/2005 | Inoue | |

(Continued)

*Primary Examiner* — Phutthiwat Wongwian
*Assistant Examiner* — Alain Chali
(74) *Attorney, Agent, or Firm* — Dority & Manning, PA

(57) ABSTRACT

A cap assembly for a bundled tube fuel injector includes an impingement plate and an aft plate that is disposed downstream from the impingement plate. The aft plate includes a forward side that is axially separated from an aft side. A tube passage extends through the impingement plate and the aft plate. A tube sleeve extends through the impingement plate within the tube passage towards the aft plate. The tube sleeve includes a flange at a forward end and an aft end that is axially separated from the forward end. A retention plate is positioned upstream from the impingement plate. A spring is disposed between the retention plate and the flange. The spring provides a force so as to maintain contact between at least a portion of the aft end of the tube sleeve and the forward side of the aft plate.

20 Claims, 6 Drawing Sheets

(56) References Cited

U.S. PATENT DOCUMENTS

| | | | | |
|---|---|---|---|---|
| 8,122,721 | B2 * | 2/2012 | Johnson | F23D 14/48 60/737 |
| 8,205,452 | B2 * | 6/2012 | Boardman | F23R 3/12 60/737 |
| 2007/0151255 | A1 | 7/2007 | Johnson | |
| 2009/0188255 | A1 * | 7/2009 | Green | F01D 9/023 60/737 |
| 2010/0084490 | A1 | 4/2010 | Zuo et al. | |
| 2010/0162708 | A1 | 7/2010 | Erickson | |
| 2010/0186413 | A1 | 7/2010 | Lacy | |
| 2010/0218501 | A1 | 9/2010 | York | |
| 2010/0287942 | A1 | 11/2010 | Zuo et al. | |
| 2013/0232977 | A1 * | 9/2013 | Siddagangaiah | F23R 3/14 60/737 |
| 2013/0283798 | A1 * | 10/2013 | Bellino | F23R 3/286 60/722 |
| 2014/0202163 | A1 * | 7/2014 | Johnson | F02C 7/00 60/752 |
| 2014/0260315 | A1 * | 9/2014 | Westmoreland | F02C 7/20 60/796 |
| 2015/0000286 | A1 | 1/2015 | LeBegue et al. | |

* cited by examiner

CAP ASSEMBLY FOR A BUNDLED TUBE FUEL INJECTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor such as may be incorporated into a gas turbine or other turbomachine. Specifically, the invention relates to a combustor having a system for supporting a bundled tube fuel injector within the combustor.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section progressively increases the pressure of the working fluid and supplies a compressed working fluid to the combustion section. A fuel is mixed with the compressed working fluid within the combustion section and the mixture is burned in a combustion chamber defined within the combustion section to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include one or more combustors annularly arranged between the compressor section and the turbine section. In a particular combustor design, the combustors include one or more axially extending bundled tube fuel injectors disposed downstream from an end cover. The end cover generally includes one or more fuel circuits that provide fuel to a fluid conduit that provides for fluid communication between the fuel circuits and a fuel plenum defined within each bundled tube fuel injector. Each bundled tube fuel injector generally includes a plurality of parallel tubes arranged radially and circumferentially across the bundled tube fuel injector. The parallel tubes extend generally axially through the fuel plenum to provide for fluid communication through the fuel plenum and into the combustion chamber. The compressed working fluid is routed through inlets of each of the parallel tubes. Fuel is supplied to the fuel plenum through the fluid conduit and the fuel is injected into the tubes through one or more fuel ports defined within each of the tubes. The fuel and compressed working fluid mix inside the tubes before flowing out of a downstream end of the tubes and into the combustion chamber for combustion.

In particular configurations, a cap assembly extends radially and circumferentially across the bundled tube fuel injector generally proximate to the downstream ends of the tubes. The cap assembly generally includes an aft plate having a plurality of tube passages. Each one of the tubes extends at least partially through a corresponding tube passage. The aft plate generally serves as a heat shield between the hot combustion gases and/or a combustion flame and the bundled tube fuel injectors. In order to cool the downstream ends or tips of the tubes, cooling air is routed through a gap provided between the tube and the aft plate. Due to various factors such as thermal growth of the tubes and or the cap plate and/or manufacturing tolerances, the gap around the perimeter of the tubes may vary significantly. As a result, the cooling air may be biased to one side or portion of the tube tip, thus providing uneven cooling to the tube tips. Uneven cooling of the tube tips may result in accelerated wear of the tube tips and/or oxidation of the tube tips. Therefore, an improved cap assembly that provides for even cooling of the downstream end or tip of the tubes of a bundled tube fuel injector would be useful.

BRIEF DESCRIPTION OF THE INVENTION

Aspects and advantages of the invention are set forth below in the following description, or may be obvious from the description, or may be learned through practice of the invention.

One embodiment of the present invention is a cap assembly for a bundled tube fuel injector. The cap assembly includes an impingement plate and an aft plate that is disposed downstream from the impingement plate. The aft plate includes a forward side that is axially separated from an aft side. A tube passage extends through the impingement plate and the aft plate. A tube sleeve extends through the impingement plate within the tube passage towards the aft plate. The tube sleeve includes a flange at a forward end and an aft end that is axially separated from the forward end. A retention plate is positioned upstream from the impingement plate. A spring is disposed between the retention plate and the flange. The spring provides a force so as to maintain contact between at least a portion of the aft end of the tube sleeve and the forward side of the aft plate.

Another embodiment of the present invention is a combustor. The combustor includes an end cover coupled to an outer casing that surrounds the combustor. A bundled tube fuel injector is disposed downstream from the end cover. The bundled tube fuel injector includes a plurality of tubes that extend axially within the combustor. Each of the tubes includes an upstream end axially separated from a downstream end. The combustor further includes a cap assembly that extends radially and circumferentially across the bundled tube fuel injector proximate to the downstream end of the tubes. The cap assembly comprises an impingement plate and an aft plate that is disposed downstream from the impingement plate. The aft plate includes a forward side that is axially separated from an aft side. A tube passage extends through the impingement plate and the aft plate. A tube sleeve extends through the impingement plate towards the aft plate. The tube sleeve is disposed within the tube passage. The tube sleeve includes a flange at a forward end and an aft end that is axially separated from the forward end. One tube of the plurality of tubes extends within the tube sleeve. A retention plate is positioned upstream from the impingement plate. A spring is disposed between the retention plate and the flange of the tube sleeve. The spring provides a force to maintain contact between at least a portion of the aft end of the tube sleeve and the forward side of the aft plate.

The present invention may also include a gas turbine. The gas turbine includes a compressor, a combustor that includes an end cover coupled to an outer casing and a turbine that is disposed downstream from the combustor. The combustor comprises a bundled tube fuel injector disposed downstream from the end cover. The bundled tube fuel injector includes a plurality of tubes that extend axially within the combustor. Each of the tubes includes an upstream end axially separated from a downstream end. The cap assembly comprises an impingement plate and an aft plate that is disposed downstream from the impingement plate. The aft plate includes a forward side that is axially separated from an aft side. A cooling air plenum is at least partially defined between the impingement plate and the aft plate. A tube passage extends through the impingement plate and the aft plate. A tube sleeve that extends through the impingement plate and the cooling air plenum towards the aft plate. The tube sleeve is disposed within the tube passage. The tube sleeve includes a flange at a forward end and an aft end that is axially separated from the forward end. One tube of the plurality of tubes extends within the tube sleeve. A retention plate positioned upstream from the impingement plate and a spring is disposed between the retention plate and the flange of the tube sleeve. The spring provides a force so as to maintain contact between at least a portion of the aft end of the tube sleeve and the forward side of the aft plate.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
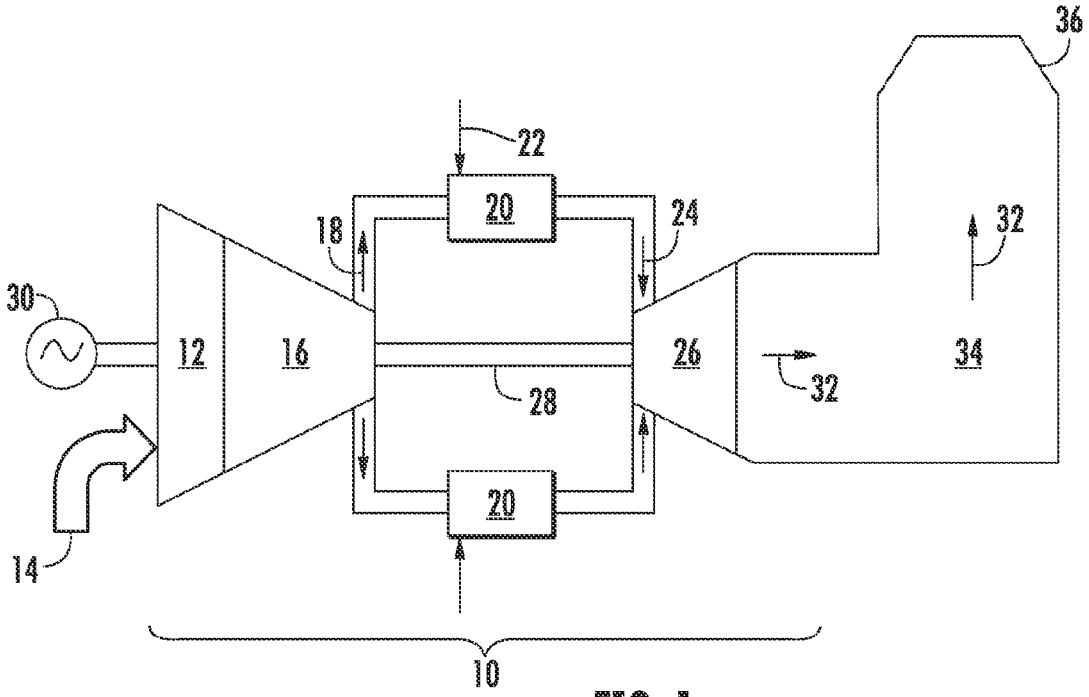
FIG. 1 provides a functional block diagram of an exemplary gas turbine that may incorporate various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel to an axial centerline of a particular component.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbo-machine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where a fuel 22 and the compressed working fluid 18 are mixed in each of the one or more combustors 20 to produce combustion gases 24 having a high temperature and pressure.

The combustion gases 24 flow through a turbine 26 where thermal and kinetic energy are transferred to one or more stages of turbine rotor blades (not shown) that are connected to a rotor shaft 28, thereby causing the rotor shaft 28 to rotate to produce work. For example, the rotor shaft 28 may be used to drive the compressor 16 to produce the compressed working fluid 18. Alternately or in addition, the rotor shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
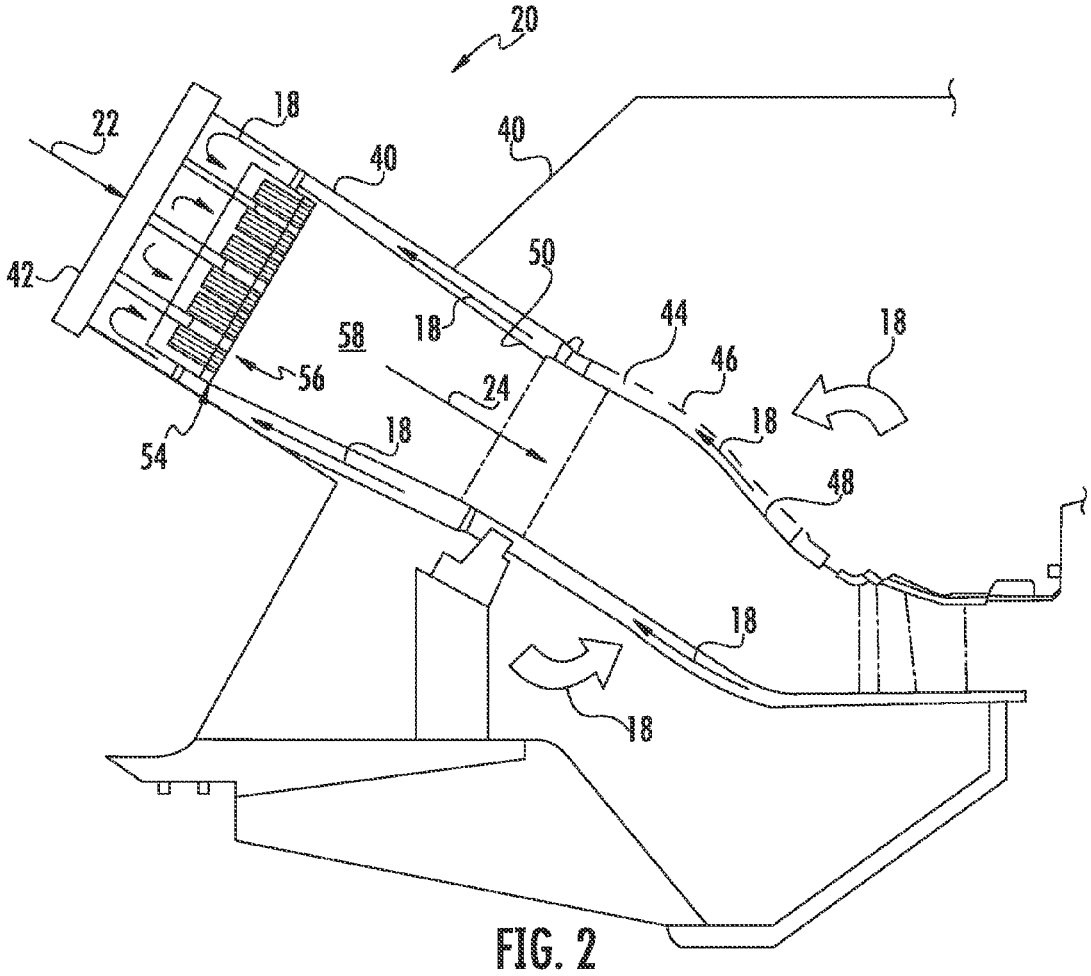
FIG. 2 provides a simplified cross-section side view of an exemplary combustor that may incorporate various embodiments of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, an outer casing 40 and an end cover 42 disposed at one end of the combustor 20 may combine to contain the compressed working fluid 18 flowing to the combustor 20. The end cover 42 may be coupled to the outer casing 40 or may be coupled to the outer casing 40 via a spacer or intermediate casing (not shown). The compressed working fluid 18 may pass through flow holes 44 in an impingement sleeve 46 to flow along the outside of a transition piece 48 and/or a liner 50 to provide convective cooling to the transition piece 48 and/or the liner 50.

The compressed working fluid 18 is routed to the end cover 42 where it reverses direction and flows through a bundled tube fuel injector 52 that is disposed downstream from the end cover 42. In particular embodiments, a cap assembly 54 extends radially and circumferentially across the bundled tube fuel injector 52 proximate to a downstream end 56 of the bundled tube fuel injector 52. Fuel 22 is provided to the bundled tube fuel injector 52 where the fuel 22 and the compressed working fluid 18 are premixed or combined within the bundled tube fuel injectors 52 before being injected into a combustion chamber 58 defined downstream from the cap assembly within the combustor 20. The mixture of fuel 22 and compressed working fluid 18 is burned in the combustion chamber 58 to generate the hot combustion gases 24.

Figure 3:
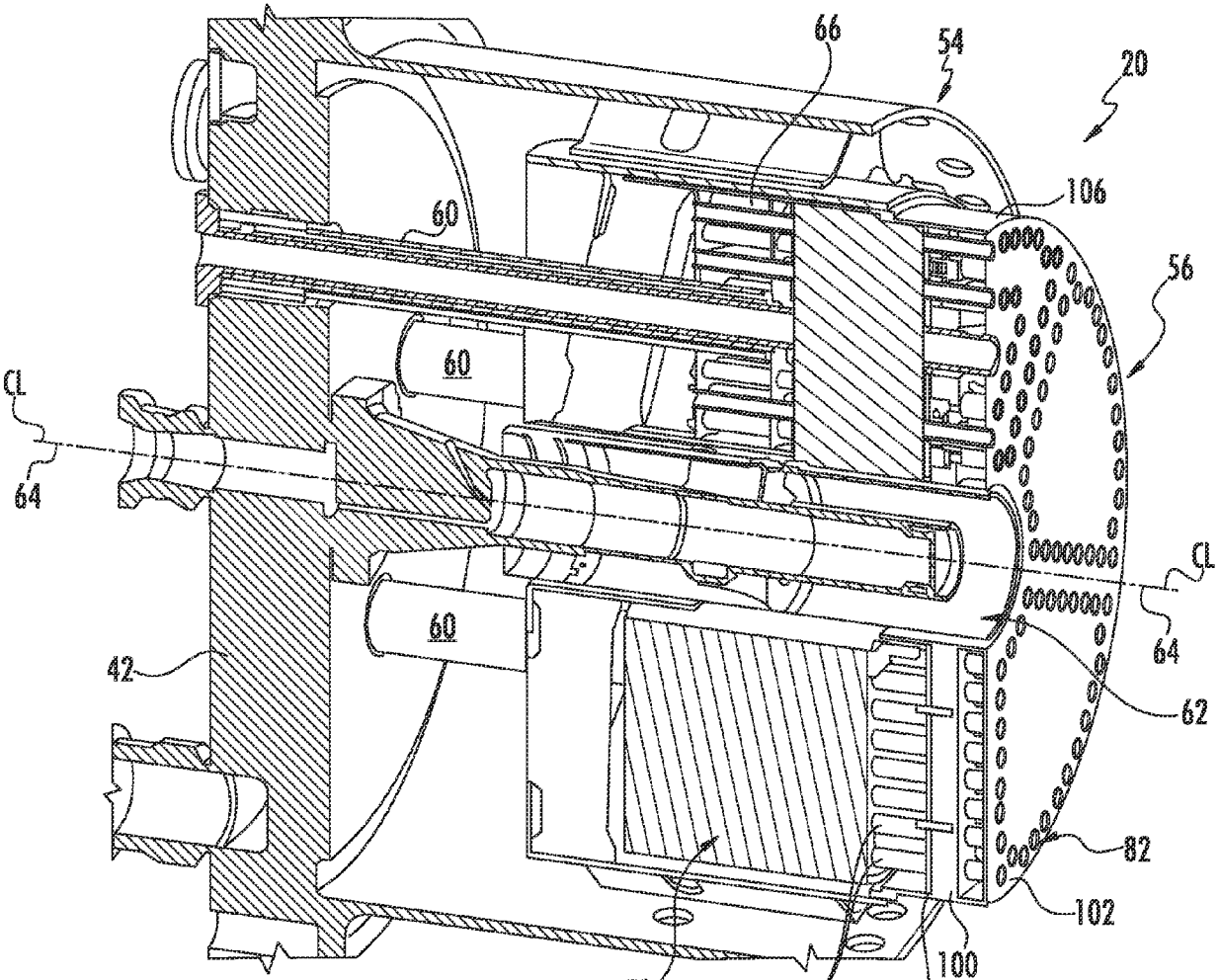
FIG. 3 provides a cross section perspective view of a portion of the combustor as shown in FIG. 2, according to one embodiment of the present invention.

FIG. 3 provides a cross section perspective view of a portion of the combustor 20 as shown in FIG. 2, according to one embodiment of the present invention. As shown in FIG. 3, one or more fluid conduits 60 provide for fluid communication between the end cover 42 and the bundled tube fuel injector 52. In particular embodiments, a center fuel nozzle 62 extends downstream from the end cover 42. The center fuel nozzle 62 extends generally axially through the bundled tube fuel injector 52. The center fuel nozzle 62 may be substantially aligned with an axial centerline 64 of the end cover 42.

Figure 4:
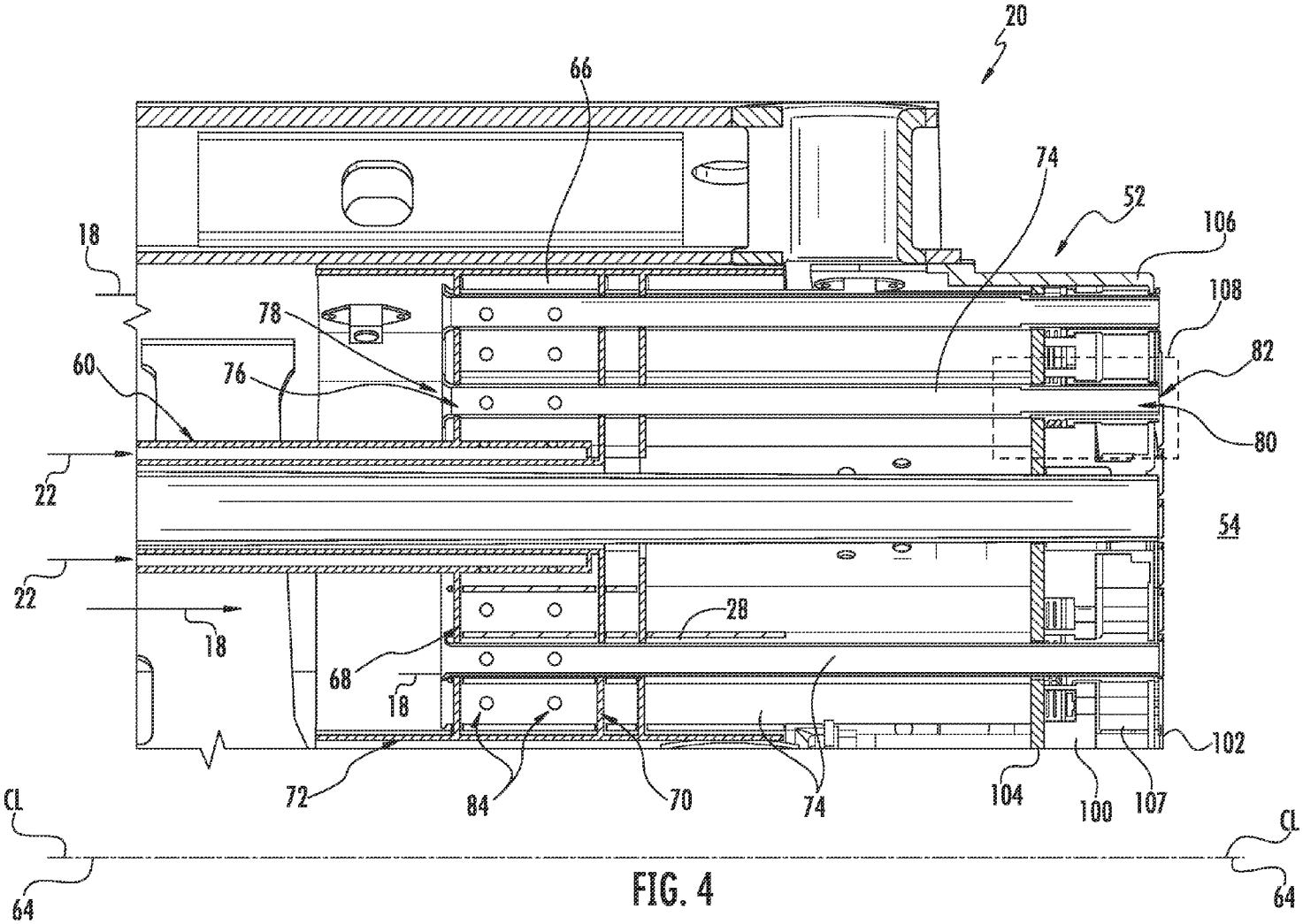
FIG. 4 provides a cross section side view of a portion of an exemplary bundled tube fuel injector as shown in FIG. 3, according to one embodiment of the present invention.

FIG. 4 provides a cross section side view of a portion of the bundled tube fuel injector 52 as shown in FIG. 3, according to various embodiments of the present invention. As shown in FIG. 4, the bundled tube fuel injector 52 generally comprises a fuel plenum 66 that is in fluid communication with the fluid conduit 60. In particular configurations, the fuel plenum 66 is generally defined between a first plate 68, a second plate 70 that is axially separated from the first plate 68 and by an outer sleeve 72 that at least partially encases the first and second plates 68, 70. In various embodiments, the bundled tube fuel injector 52 comprises a plurality of tubes 74. The tubes 74 extend generally axially within the combustor with respect to centerline 64. As shown, the tubes 74 are substantially parallel to each other.

Each tube 74 generally includes an inlet 76 defined at an upstream end 78 and an outlet 80 defined at a downstream end or tip 82 of the tube 74. The upstream end 78 is axially separated from the downstream end 82. Although generally illustrated as cylindrical tubes in each embodiment, the cross-section of the tubes 74 may be any geometric shape, and the present invention is not limited to any particular cross-section unless specifically recited in the claims. Each or some of the tubes 74 may include one or more fuel ports 84 that provide for fluid communication between the fuel plenum 66 and the tubes 74. In this manner, as the compressed working fluid enters the inlet 76 of the tubes, the fuel 22 may be injected into the tubes 74 from the fuel plenum 66 to provide the fuel 22 and compressed working fluid 18 mixture to the combustion chamber 54.

The tubes 74 may be grouped in circular, triangular, square, or other geometric shapes and the tubes 74 may be arranged in various numbers and geometries. For example, in particular configurations, the bundled tube fuel injector may comprise a plurality of arcuate or wedge shaped bundled tube fuel injector segments (not shown) arranged in an annular array about the centerline 64 where each bundled tube fuel injector segment is configured the same or substantially similar to the bundled tube fuel injector 52 described herein.

Referring back to FIG. 3, the cap assembly 54 extends radially and circumferentially across the bundled tube fuel injector 52 proximate to the downstream 82 end of the tubes 74 and/or the downstream end 56 of the bundled tube fuel injector 52. The cap assembly 54 may extend generally radially outward with respect to centerline 64 and circumferentially across the downstream end 56 of the bundled tube fuel injector 52 with respect to centerline 64.

In particular embodiments, as shown in FIGS. 3 and 4, the cap assembly 54 includes an impingement plate 100 and an aft plate 102 that is disposed downstream from the impingement plate 100. In further embodiments, the cap assembly 54 further comprises a retention plate 104 that is disposed upstream from the impingement plate 100. In further embodiments, the cap assembly includes an outer sleeve 106 that extends circumferentially around the impingement plate 100. The aft plate 102 may be connected to outer sleeve 106. As shown in FIG. 3, the impingement plate 100 and/or the aft plate 102 may be generally annular shaped so as circumferentially surround the center fuel nozzle 62. In particular embodiments, as shown in FIG. 4, a cooling air plenum 107 may be at least partially defined between the impingement plate 100, aft plate 102 and the outer sleeve 106.

Figure 5:
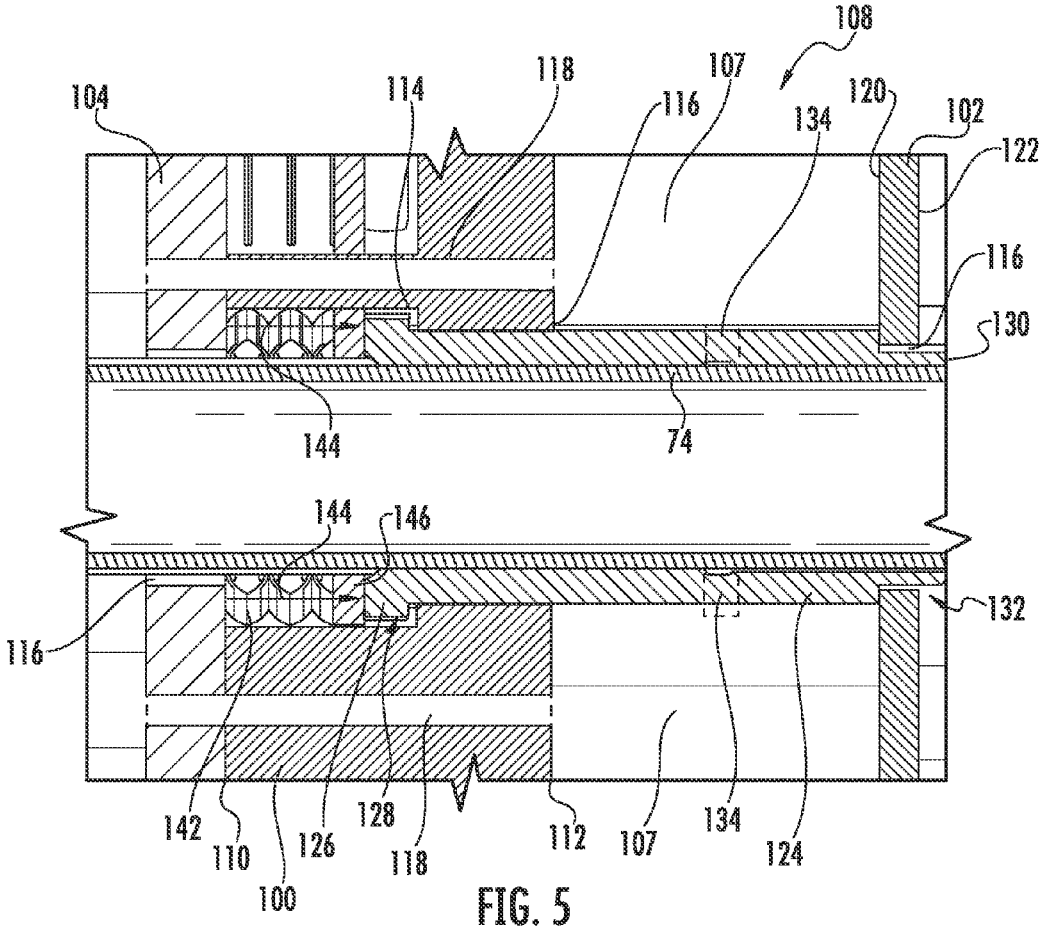
FIG. 5 provides an enlarged cross section side view of a portion of a cap assembly as shown in FIG. 4, according to various embodiments of the present invention.

FIG. 5 provides an enlarged cross section side view as outlined in FIG. 4 within dotted line 108, according to various embodiments of the present invention. As shown in FIG. 5, the impingement plate 100 generally includes a first side 110 and a second side 112. The second side 112 is generally axially separated from the first side 110. In one embodiment, the impingement plate 100 at least partially defines a pocket 114. The pocket 114 extends through the first side 110 towards the second side 112. The pocket 114 may be generally cylindrical in shape.

The impingement plate 100 at least partially defines a tube passage 116 that extends generally axially through the cap assembly 54. The pocket may be coaxially aligned with the tube passage 116. The pocket 114 may be disposed generally adjacent to the retention plate 104. In particular configurations, one or more impingement passages 118 extend through the impingement plate 100. The impingement passages 118 provide for fluid communication through the impingement plate 100 into the cooling air plenum 107. The aft plate 102 further defines the tube passage 116 through the cap assembly 54. The aft plate 102 generally includes a forward side 120 and an aft side 122. The forward side 120 is generally axially separated from the aft side 122. The retention plate 104 may further define the tube passage 116.

In particular embodiments, a tube sleeve 124 extends through the impingement plate 100 within the tube passage 116. The tube sleeve 124 generally extends from the impingement plate 100 towards the aft plate 102. The tube sleeve 124 includes a flange 126 that extends circumferentially around at least a portion of a forward end 128 of the tube sleeve 124. In particular embodiments, the flange 126 and/or the forward end 128 of the tube sleeve 124 is disposed concentrically within the pocket 114. The tube sleeve 124 further includes an aft end 130 that is spaced axially apart from the forward end 128. The tube sleeve 124 extends at least partially through the cooling air plenum 107 towards the forward side 120 of the aft plate 102. One tube 74 of the plurality of tubes 74 extends within through the tube sleeve 124. The tube generally extends concentrically within the tube sleeve 124.

Figure 6:
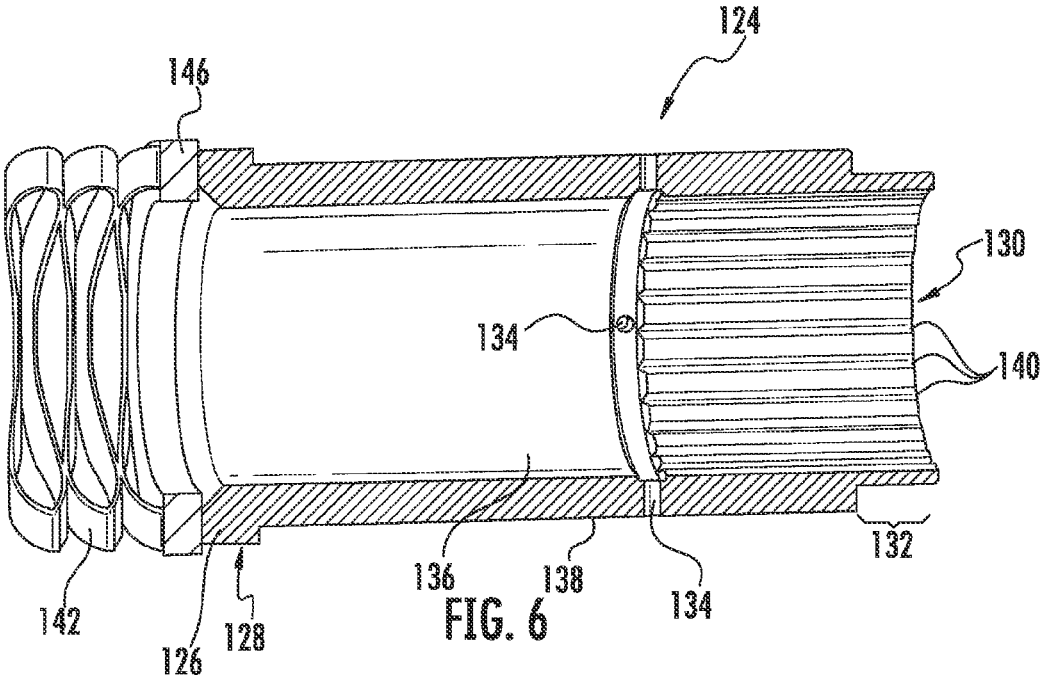
FIG. 6 provides a cross section side view of a tube sleeve as shown in FIG. 5, according to one embodiment of the present invention.

FIG. 6 provides a cross section side view of the tube sleeve 124 as shown in FIG. 5, according to one embodiment of the present invention. In one embodiment, as shown in FIGS. 5 and 6, the tube sleeve 124 includes a step feature 132 such as a rabbet cut or notch that extends circumferentially around at least a portion of the aft end 130 of the tube sleeve 124. In particular embodiments, as shown in FIG. 5, the step feature 132 allows a portion of the downstream end 130 of the tube sleeve 124 to mate or engage with a portion of the forward side 120 of the aft plate 102 while allowing at least another portion of the downstream end 130 of the tube sleeve 124 to extend through the aft plate 102. In one embodiment, a portion of the aft end 130 of the tube sleeve 124 extends downstream from the aft side 122 of the aft plate 102.

In particular embodiments, as shown in FIGS. 5 and 6, one or more cooling ports 134 extend through the tube sleeve 124. The cooling ports 134 are in fluid communication with the cooling air plenum 107. In particular embodiments, as shown in FIG. 6, the tube sleeve 124 includes an inner surface 136 radially separated from an outer surface 138. A plurality of cooling channels 140 are defined within and/or along the inner surface 136. The cooling channels 140 may extend generally axially along the inner surface 136. In addition or in the alternative, the cooling channels 140 may be helical or rifled. In particular embodiments, the cooling channels 140 are in fluid communication with the cooling ports 134.

Figure 7:
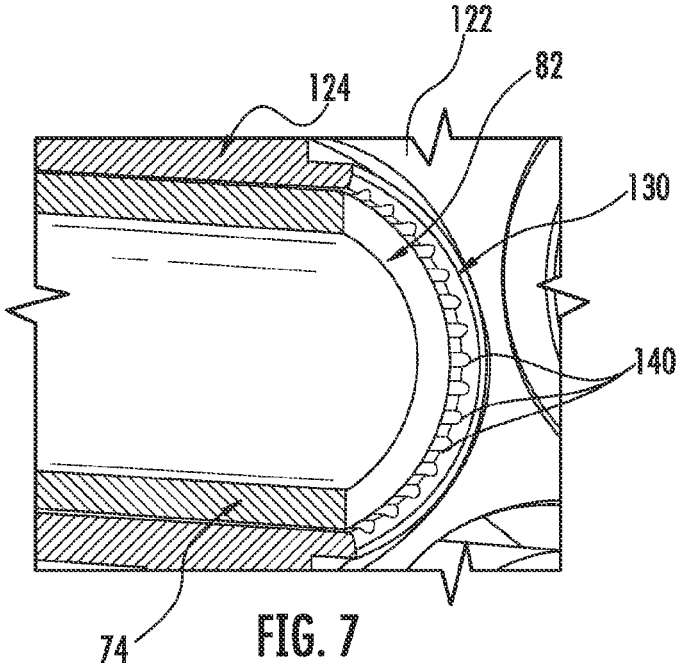
FIG. 7 provides an enlarged perspective view of a downstream end of a tube that is circumferentially surrounded by an aft end of the tube sleeve as shown in FIG. 5, according to one embodiment of the present invention.

FIG. 7 provides an enlarged perspective view of the downstream end 82 of one tube 74 of the plurality of tubes 74 circumferentially surrounded by the aft end 130 of the tube sleeve 124. In particular embodiments, as shown in FIG. 7. The cooling channels 140 are disposed and/or extend between the downstream end 82 of the tube 74 and the inner surface 136 of the tube sleeve 124.

Referring back to FIG. 5, in particular embodiments, a spring 142 is disposed between the retention plate 104 and the flange 126 of the tube sleeve 124. The spring 142 may extend circumferentially around the tube 74. In one embodiment, the spring is disposed generally concentrically within the pocket 114. The spring 142 may include any type of spring that will apply an axial force 144 to the flange 126 while allowing for the tube 74 to extend through the tube sleeve 124. For example, the spring 142 may be a wave spring or a helical spring. The spring 142 generally applies the axial force 144 against the tube sleeve 124, particularly the flange 126, so as to maintain contact between at least a portion of the aft end 130 of the tube sleeve 124 and the forward side 120 of the aft plate 102. In particular embodiments, the axial force 144 is sufficient to provide a seal between the portion of the aft end 130 of the tube sleeve 124 and the forward side 120 of the aft plate 102.

In one embodiment, as shown in FIGS. 5 and 6, a washer 146 is disposed between the spring 142 and the flange 126 and/or the tube sleeve 124. The washer 146 may be disposed generally concentrically within the pocket 114. In alternate embodiments, the washer 146 may be disposed between the retention plate 104 and the spring 142.

In operation, in one embodiment as shown in the various figures presented and described herein, the compressed working fluid 18 or other cooling medium is routed through the impingement passages 118 and into the cooling air plenum 107. The compressed working fluid 18 impinges on the forward side 120 of the aft plate 102 to provide impingement cooling to the aft plate 102. The spring 142 provides a sufficient axial force 144 to maintain contact and/or a seal or a partial seal between at least a portion of the downstream end 130 of the tube sleeve 124 and the forward side 120 of the aft plate 102, thereby improving cooling efficiency of the compressed working fluid 18 within the cooling air plenum 107 and/or within the combustor 20. A portion of the compressed working fluid 18 flows through the cooling ports 134 and into the cooling channels 140 to provide even cooling around a perimeter of the downstream end 82 of the tube 74, thereby evenly cooling the downstream end 82 and/or improving overall durability of the tube 74. Although a single tube sleeve 124, a tube passage 116, a spring 142 and a washer 146 are used to describe the invention herein, it should be obvious to one of ordinary skill in the art that the cap assembly 54 may contain a plurality of tube sleeves, springs and washers that surround the plurality of tubes 74 of the bundled tube fuel injector 52 that extend through the cap assembly 54 and that function as described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A cap assembly for a bundled tube fuel injector, comprising:

a. an impingement plate;

b. an aft plate disposed downstream from the impingement plate, the aft plate having a forward side axially separated from an aft side;

c. a tube passage that extends through the impingement plate and the aft plate;

d. a tube sleeve that extends through the impingement plate within the tube passage towards the aft plate, the tube sleeve having a flange at a forward end and an aft end axially separated from the forward end;

e. a retention plate positioned upstream from the impingement plate; and f. a spring disposed between the retention plate and the flange, wherein the spring provides an axial force to maintain contact between at least a portion of the aft end of the tube sleeve and the forward side of the aft plate, wherein the tube sleeve is axially movable with respect to the impingement plate.

2. The cap assembly as in claim 1, further comprising a washer disposed between the spring and the flange.

3. The cap assembly as in claim 1, wherein the impingement plate defines a pocket that is coaxially aligned with the tube passage, the flange of the tube sleeve and the spring being disposed concentrically within the pocket.

4. The cap assembly as in claim 1, wherein a portion of the aft end of the tube sleeve extends through the aft plate.

5. The cap assembly as in claim 1, wherein the tube sleeve includes an inner surface radially separated from an outer surface and a plurality of cooling channels defined within the inner surface.

6. The cap assembly as in claim 5, wherein the tube sleeve includes one or more cooling ports that provide for fluid communication through the tube sleeve into the cooling channels.

7. The cap assembly as in claim 6, further comprising a cooling air plenum at least partially defined between the impingement plate and the aft plate, wherein the cooling port is in fluid communication with the cooling air plenum.

8. The cap assembly as in claim 1, wherein the impingement plate and the aft plate at least partially define a center fuel nozzle passage that extends axially therethrough.

9. A combustor, comprising:

a. an end cover coupled to an outer casing that surrounds the combustor;

b. a bundled tube fuel injector disposed downstream from the end cover, the bundled tube fuel injector having a plurality of tubes that extend axially within the combustor, each of the tubes having an upstream end axially separated from a downstream end; and c. a cap assembly that extends radially and circumferentially across the bundled tube fuel injector proximate to the downstream end of the tubes, the cap assembly comprising:

i. an impingement plate;

ii. an aft plate disposed downstream from the impingement plate, the aft plate having a forward side axially separated from an aft side;

iii. a tube passage that extends through the impingement plate and the aft plate;

iv. a tube sleeve that extends through the impingement plate towards the aft plate, the tube sleeve being disposed within the tube passage, the tube sleeve having a flange at a forward end and an aft end that is axially separated from the forward end, wherein one tube of the plurality of tubes extends within the tube sleeve;

d. a retention plate positioned upstream from the impingement plate; and e. a spring disposed between the retention plate and the flange of the tube sleeve, wherein the spring provides an axial force to maintain contact between at least a portion of the aft end of the tube sleeve and the forward side of the aft plate, wherein the tube sleeve is axially movable with respect to the impingement plate.

10. The combustor as in claim 9, further comprising a washer disposed between the spring and the flange.

11. The combustor as in claim 9, wherein the impingement plate defines a pocket that is coaxially aligned with the tube passage, the flange of the tube sleeve and the spring being disposed within the pocket.

12. The combustor as in claim 9, wherein a portion of the aft end of the tube sleeve extends through the aft plate.

13. The combustor as in claim 9, wherein the impingement plate and the aft plate at least partially define a center fuel nozzle passage that extends axially therethrough.

14. The combustor as in claim 9, wherein the tube sleeve includes an inner surface radially separated from an outer surface and a plurality of cooling channels defined within the inner surface between the tube and the tube sleeve.

15. The combustor as in claim 14, wherein the tube sleeve includes one or more cooling ports that provide for fluid communication through the tube sleeve into the cooling channels.

16. The combustor as in claim 15, further comprising a cooling air plenum at least partially defined between the impingement plate and the aft plate, wherein the cooling port is in fluid communication with the cooling air plenum.

17. A gas turbine, comprising:

a. a compressor;

b. a combustor disposed downstream from the compressor, wherein the combustor includes an end cover coupled to an outer casing;

c. a turbine disposed downstream from the combustor; and d. wherein the combustor comprises a bundled tube fuel injector disposed downstream from the end cover, the bundled tube fuel injector having a plurality of tubes that extend axially within the combustor, each of the tubes having an upstream end axially separated from a downstream end, the cap assembly comprising:

i. an impingement plate;

ii. an aft plate disposed downstream from the impingement plate, the aft plate having a forward side axially separated from an aft side;

iii. a cooling air plenum at least partially defined between the impingement plate and the aft plate;

iv. a tube passage that extends through the impingement plate and the aft plate;

v. a tube sleeve that extends through the impingement plate and the cooling air plenum towards the aft plate, the tube sleeve being disposed within the tube passage, the tube sleeve having a flange at a forward end and an aft end that is axially separated from the forward end, wherein one tube of the plurality of tubes extends within the tube sleeve;

e. a retention plate positioned upstream from the impingement plate; and f. a spring disposed between the retention plate and the flange of the tube sleeve, wherein the spring provides an axial force to maintain contact between at least a portion of the aft end of the tube sleeve and the forward side of the aft plate, wherein the tube sleeve is axially movable with respect to the impingement plate.

18. The gas turbine as in claim 17, wherein a portion of the aft end of the tube sleeve extends through the aft plate.

19. The gas turbine as in claim 17, wherein the tube sleeve includes an inner surface radially separated from an outer surface and a plurality of cooling channels defined within the inner surface between the tube and the tube sleeve.

20. The as turbine as in claim 19, wherein the tube sleeve includes one or more cooling ports that provide for fluid communication between the cooling air plenum and the cooling channels.

* * * * *